United States Patent [19]

Miller

[11] 4,367,434

[45] Jan. 4, 1983

[54] LAMPHOLDER FITTING WITH THREE-WAY BRIGHTNESS SOLID-STATE FLUORESCENT LAMP BALLAST

[76] Inventor: Jack V. Miller, 700 N. Auburn Ave., Sierra Madre, Calif. 91024

[21] Appl. No.: 163,391

[22] Filed: Jun. 26, 1980

[51] Int. Cl.[3] ..... H01J 7/44; H01J 17/34; H01J 19/78; H01J 29/96

[52] U.S. Cl. ..... 315/51; 315/53; 315/DIG. 4; 315/240; 315/362; 315/74; 315/DIG. 5

[58] Field of Search ..... 315/DIG. 4, DIG. 5, 315/DIG. 7, 51, 53, 74, 75, 52, 240, 362

[56] References Cited

U.S. PATENT DOCUMENTS

| | | | |
|---|---|---|---|
| 3,323,013 | 5/1967 | Lord | 315/DIG. 4 |
| 3,754,160 | 8/1973 | Jensen | 315/DIG. 7 |
| 3,935,505 | 1/1976 | Spiteri | 315/DIG. 4 |
| 4,082,981 | 4/1978 | Morton et al. | 315/309 |
| 4,146,820 | 3/1979 | Bessone et al. | 315/DIG. 4 |
| 4,163,925 | 8/1979 | Gyursaszky | 315/DIG. 4 |
| 4,173,730 | 11/1979 | Young et al. | 315/DIG. 5 |
| 4,178,535 | 12/1979 | Miller | 315/53 |
| 4,284,925 | 8/1981 | Bessone et al. | 315/DIG. 4 |

*Primary Examiner*—Saxfield Chatmon, Jr.

[57] ABSTRACT

A fluorescent lampholder fitting has a fluorescent lamp having first and second ends respectively provided with starting filaments. The lamp is supported by a housing which also encloses a solid-state fluorescent ballast and which also incorporates a male screw base electrical connector for supporting the housing in a portable lamp or lighting fixture. The male screw base is provided with three electrical input connections so configured to be electrically connected and selectively switched when installed in a three-way lampholder of the portable lamp or lighting fixture. The lampholder fitting is provided with a center-tapped step-down transformer which has three terminals attached to the three respective connections of the three-way male screw base. The step-down transformer has a single low-voltage secondary winding which connects to the input terminals of a full-wave bridge rectifier which has its rectified output connected to a high frequency oscillator. The oscillator output drives the primary winding of a step-up transformer having a tapped secondary winding wherein the taps of a first secondary segment are connected to one lead of each respective lamp filament, and wherein the taps terminating at least one other secondary winding segment are connected to both leads of one lamp filament whereby the first secondary winding segment provides relatively high voltage lamp running current and the second segment provides relatively low voltage filament heating current.

5 Claims, 5 Drawing Figures

LAMPHOLDER FITTING WITH THREE-WAY BRIGHTNESS SOLID-STATE FLUORESCENT LAMP BALLAST

BACKGROUND OF THE INVENTION

This invention relates to lighting fixtures, and more particularly to fluorescent lampholder fittings which are adapted to screw into portable lamps and lighting fixtures. Fluorescent light sources which are adapted to replace an incandescent lamp in portable lamps and lighting fixtures are currently known and have become widely used since the introduction of products based on the applicant's U.S. Pat. No. 4,016,020 for a circline fluorescent lampholder fitting, and U.S. Pat. No. 4,015,276 for a fluorescent lampholder to connect a circline fluorescent lamp to a male screw base housing. Further, certain fluorescent lampholder fittings have been marketed that employ solid-state ballasts which have improved efficiency over the more commonly used inductor ballasts. Solid-state fluorescent ballasts typically employ an AC-to-DC converter and an inverter circuit of a single or multi-level output, which may be illustrated by the applicant's U.S. Pat. No. 3,215,723, capable of providing lamp and filament heater current from a tapped secondary transformer winding.

Recently disclosed is the applicant's U.S. Pat. No. 4,178,535 which teaches the use of multi-level fluorescent lamp operation using the built-in selective switching of a three-way lampholder of a portable lamp or lighting fixture, and using a plurality of inductor windings to control lamp current and therefore brightness. The practicality of utilizing fluorescent light sources in incandescent lampholders (sockets) was further enhanced by the teaching of the applicant's U.S. Pat. No. 4,198,112 showing torque-limiting male screw bases in both one-way and three-way brightness configurations.

It is noted that there are currently-known three-way brightness solid-state ballasted fluorescent lampholder fittings. However these devices provide the brightness control through a separate switch on the lampholder fitting, and do not utilize the three-way switching capability of the lampholder of the portable lamp supporting the fitting. At the present time nearly all of the portable lamps sold for residential use employ three-way lampholders. The availability of high efficiency fluorescent converters which are suited to the switching system built into the lamps, and to which the user is accustomed, is important to market acceptance of energy efficient residential lighting products.

SUMMARY OF THE INVENTION

The general purpose of the invention is provide a three-way brightness fluorescent lampholder fitting that screws directly into a three-way socket of a portable lamp or light fixture, and is operable at three brightness levels switchable by the integrally switched socket.

A solid state inverter ballast comprises an oscillator to convert DC current to AC current, and is commonly available in many circuit arrangements. The present invention provides three-level DC to the oscillator by connecting a tapped primary step down transformer to a three-way male screw base, and rectifying the secondary low voltage for input to the oscillator. The oscillator produces low voltage AC current which is stepped up to appropriate lamp operating voltage by a step-up transformer.

Preferred embodiments include taps on the secondary winding of the step-up transformer to energize lamp filaments and facilitate lamp starting.

Other preferred embodiments include taps on the secondary winding of the step-up transformer to operate more than one lamp at a time, with three-way operation achieved by simultaneous dimming of the lamps.

The lamps illustrated herein are either circline or straight lamps for clarity of disclosure. However, it is noted that the many types of fluorescent lamps exist which are well suited to lampholder fitting use, and which are operable with the techniques disclosed, such as small mercury vapor lamps that have small gas discharge tubes coated with fluorescent phosphors, and a wide variety of coiled, serpentine and convoluted lamps having various sizes of phosphor coated gas discharge tubes.

BRIEF DESCRIPTION OF THE DRAWINGS

The features of the preferred embodiments of the invention are illustrated in the drawings, in which.

DETAILED DESCRIPTION OF THE PREFERRED EMBODIMENTS

Figure 1:
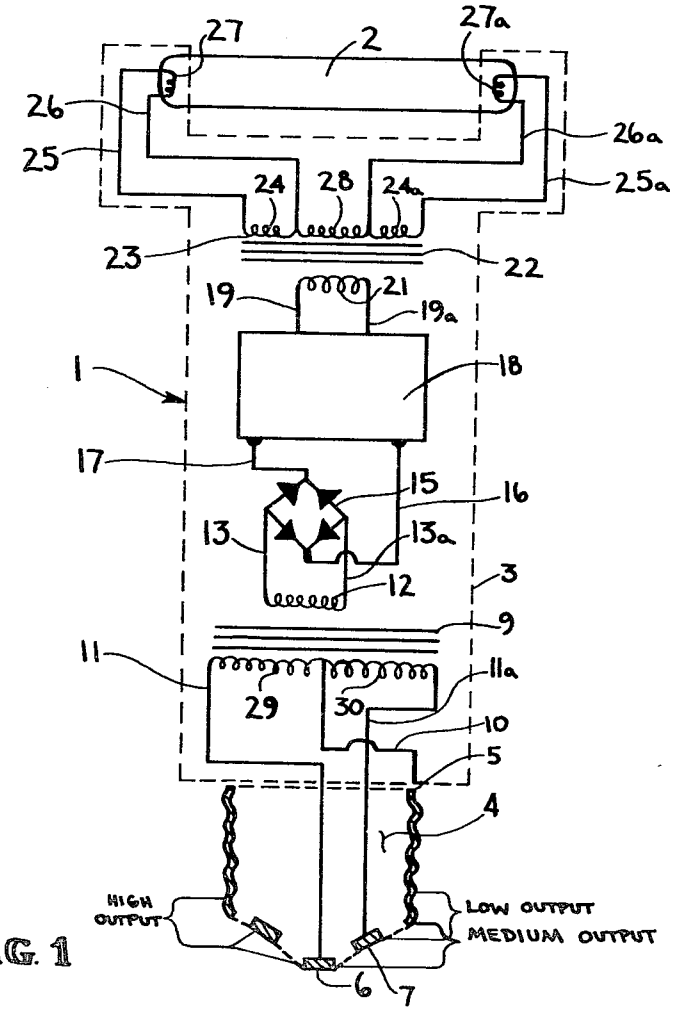
FIG. 1 is a schematic of a three-way brightness fluorescent lampholder fitting employing an inverter ballast and a fluorescent lamp.

In FIG. 1 a lampholder fitting 1 is shown having a fluorescent lamp 2 which is supported by a housing 3, which is in turn supported by a three-way male screw base 4. The male screw base 4 adapted to operation in an integrally switched three-way lampholder is provided with three electrical input connections; a screw shell connection 5, a center connection 6 and an intermediate ring connection 8. A step-down transformer 9 is provided with three primary winding leads, including a first lead, center tap 10, which is connected to screw shell 5; a second lead, end tap 11, which is connected to center connection 6; and a third lead, end tap **11*a*, which is connected to the intermediate ring 8**.

Step-down transformer 9 is also provided with a low-voltage output secondary winding 12 having output leads 13 and **13*a* connected to the input of a full-wave bridge rectifier 15. The output leads 16 and 17 of rectifier 13 are connected to a high-frequency oscillator 18, having its output leads 19 and 19*a* driving the primary winding 21 of step-up transformer 22. Transformer 22 is also provided with a three segment secondary winding 23, in which a first winding segment 24 has output leads 25 and 26 connected to the leads of a first lamp filament 27 of lamp 2, and a second winding segment 24*a* has output leads 25*a* and 26*a* connected to a second lamp filament 27*a* of lamp 2. The third winding segment 28 of secondary winding 23 supplies lamp running voltage and current to leads 26 and 26a** which connect to one end respectively of each lamp filament.

When the male screw base 4 is screwed into a three-way lampholder of a portable lamp or lighting fixture, the first switching position on the lampholder will apply 118 volt AC to screw shell 5 and center contact 6. This energizes primary winding 29 of step-down transformer 9, applying low-current, low voltage AC to the rectifier 16. Rectifier 16 then provides low-voltage DC current to the high-frequency oscillator 18, which drives the primary winding 21 of step-up transformer 22. The output of the secondary step-up transformer winding 23 energizes the filaments 27 and 27a of lamp 2 with heater current from winding segments 24 and 24a respectively, and further supplies high-voltage, relatively low current across filaments 27 and 27a to operate the lamp at the relatively low brightness levels.

The second switch position of the three-way lampholder applies AC to the screw shell 5 and the intermediate ring 7. This energizes the primary winding 30 of the step-down transformer 9 at a higher current level than winding 29 would produce in the first switching position, producing a higher voltage and current in the secondary winding 12, and permitting the rectifier 15 to drive the oscillator 18 at higher current. This in turn supplies higher current to the step-up transformer, which operates the lamp in a brighter mode.

The third switch position of the three-way lampholder applies AC to the screw shell 5 and both the center contact 6 and the intermediate ring 7 of the screw base 4. Both of the primary windings 29 and 30 of step-down transformer 9 are energized, creating a still higher current in the secondary winding 12, and supplying the rectifier 15 with more current to rectify and drive oscillator 18. Oscillator 18 then supplies higher current to the step-up transformer 22, to drive lamp 2 at its brightest level.

In a fourth position of the switch in a three-way lampholder the AC is disconnected from both the center contact 6 and the intermediate contact 7, interrupting current flow and rendering the circuit inoperative.

Figure 2:
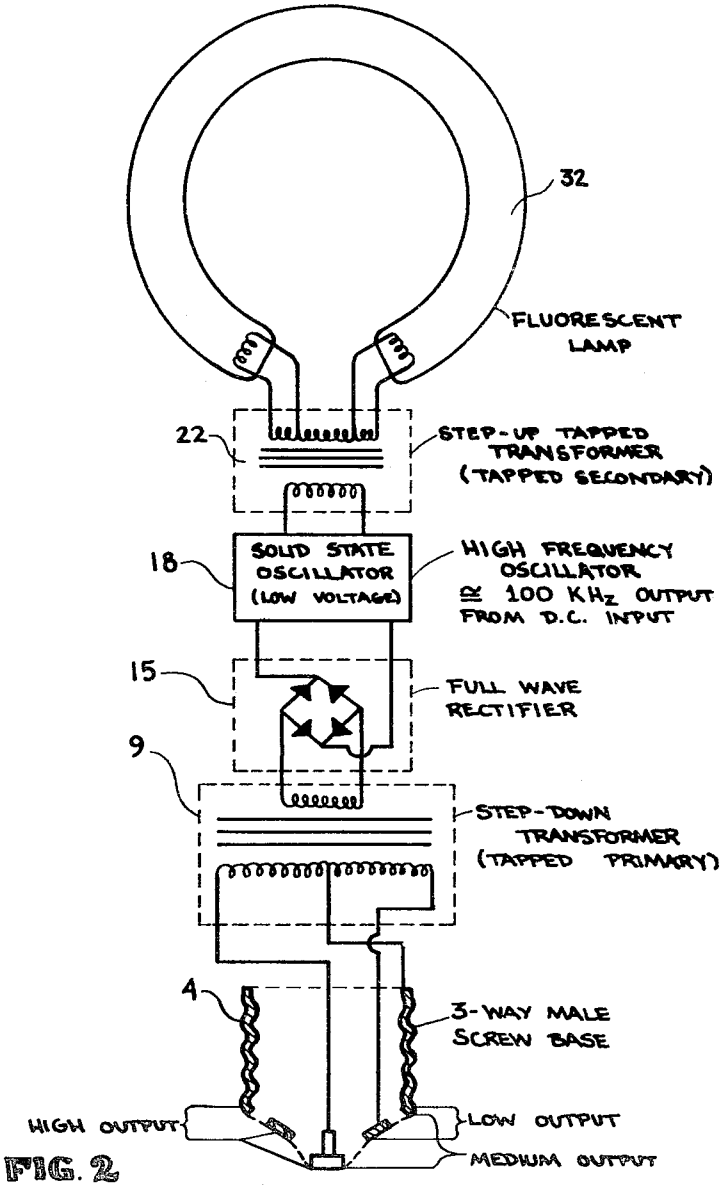
FIG. 2 is a schematic of a three-way brightness fluorescent lampholder fitting of FIG. 1, employing a circline fluorescent lamp.

In FIG. 2 the fluorescent lamp 32 is shown having circular form, which is a preferred embodiment for operation with portable lamps employing circular lamp shades. All components are identical in function to those described in FIG. 1.

Figure 3:
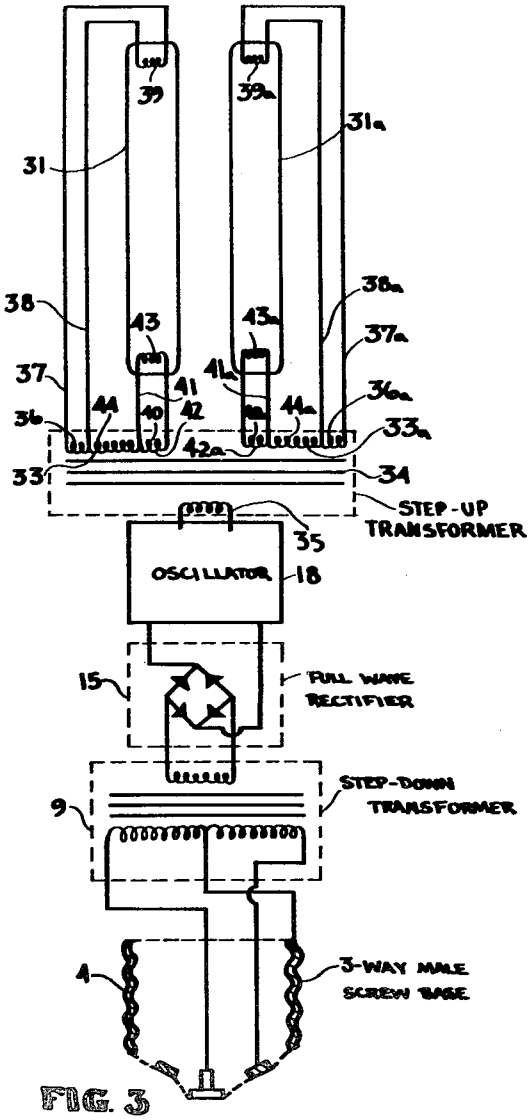
FIG. 3 is a schematic of a three-way brightness fluorescent lampholder fitting employing an inverter ballast operating two fluorescent lamps.

In FIG. 3 two fluorescent lamps 31 and 31a are shown being driven from the multi-tapped secondary windings 33 and 33a respectively, of step-up transformer 34 which has a primary winding 35 being driven by the oscillator 18. The functions of oscillator 18 and all other components from oscillator 18 to the screw base 4 are identical to those circuits shown and described in FIG. 1. Step-up transformer 34, now provided with two three-segment secondary windings 33 and 33a, is capable of driving both lamps 31 and 31a through the brightness steps described for FIG. 1, and although both lamps are illustrated the same, they may be varied in size with appropriate winding selection for the transformer. For the configuration shown, winding segment 36 has output leads 37 and 38 connected to the first lamp filament 39 of the first lamp 31. Winding segment 40 has output leads 41 and 42 connected to the second filament 43 of the first lamp 31, and winding segment 44 supplies lamp running voltage and current to leads 38 and 41 which connect to one end, respectively, of each filament of the first lamp. Also, winding segment 36a has output leads 37a and 38a connected to the first lamp filament 39a of the second lamp 31a. Winding segment 40a has output leads 41a and 42a connected to the second filament 43a of the second lamp 31a, and winding segment 44a supplies lamp running voltage and current to leads 38a and 41a which connect to one end, respectively, of each filament of the second lamp. Although the foregoing describes the two lamps as electrically isolated from each other for clarity of description, the two lamps may share certain common leads where the lamp functions would not interfere.

Figure 4:
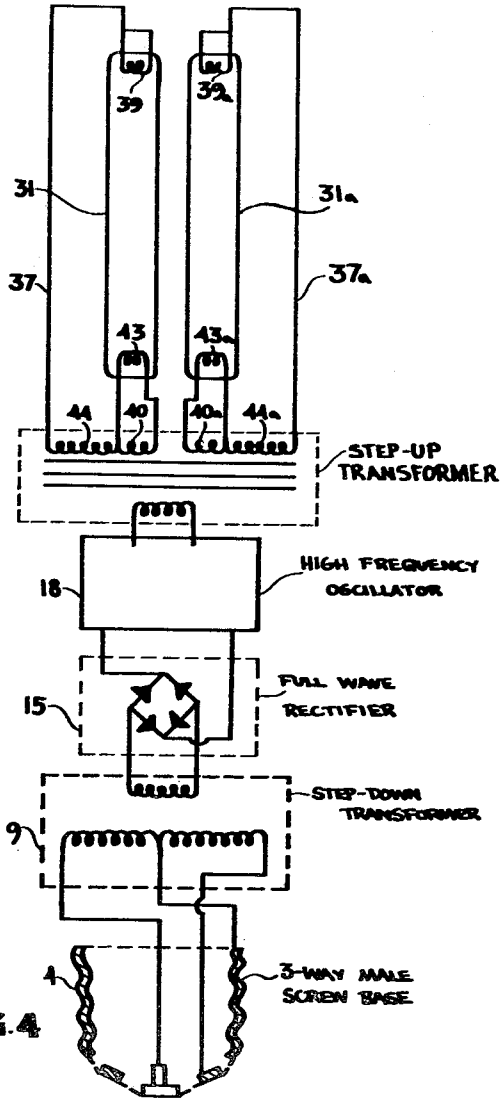
FIG. 4 is a schematic of a three-way brightness fluorescent lampholder fitting with only one heated filament per lamp.

In FIG. 4 an embodiment is shown which is an optional simplification of a two lamp circuit otherwise identical to that described and shown in FIG. 3. The use of rather high starting and running voltages for small lamps operating on inverter ballasts will sometimes provide acceptable starting characteristics with the use of only one starting filament per lamp. In this simplified configuration the step-up transformer secondary winding segments 40 and 40a supply filament heater current through lamp filaments 43 and 43a, respectively. The opposite lamp filaments 39 and 39a have their respective leads connected so that no heater current flows through the filaments, and therefore they act as gas discharge electrodes only.

Figure 5:
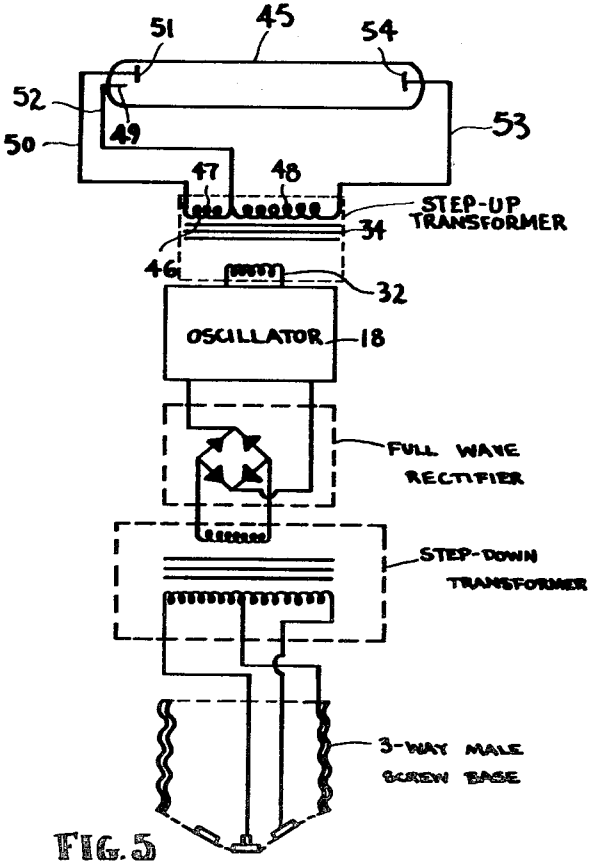
FIG. 5 is a schematic of a three-way brightness fluorescent lampholder fitting using a cold cathode gas discharge lamp.

In FIG. 5 an embodiment is shown which is a simplification of FIG. 1, in which preheat current is supplied to a starting electrode of a cold cathode lamp 45, such as the type commonly used in metallic vapor lamps. The step-up transformer has a primary winding 32 and an inductive core 43 energizing a tapped secondary winding 46 which is comprised of a starting segment 47 and running segment 48. Segment 47 has a first output lead 48 connected to a starting electrode 49 of lamp 45, and a second output lead 50 connected to a first running electrode 51 of lamp 45. Segment 48 has a first output lead 52 common with segment 47 and a second output lead 52 connected to the second running electrode 54 of lamp 45. In operation a relatively low potential between starting electrode 49 and first running electrode 51 is provided by segment 47, whereby the close proximity of electrodes 49 and 51 permits an arc discharge through the lamp gas to create ionization in a manner similar to that of an incandescent heater filament of FIG. 1. A higher potential is established between running electrodes 51 and 54 by segment 48 whereby some of the ions pass through the lamp and establish current flow through the lamp. As the arc develops through the lamp the current through the starting arc diminishes and the lamp running current is supplied by the entire secondary winding using output leads 50 and 53 driving lamp electrodes 51 and 54.

The embodiments shown and described are in the form of simple schematics of operable circuits. It is well known, and considered within the scope of this invention that additional components such as capaciters may be placed appropriately to tune the specific circuit for optimum efficiency and power factor for any respective lamp. Such devices are in common usage in both inductor and inverter ballasts, and are omitted from this disclosure in the interest of simplicity and clarity of the drawings and specification.

I claim:

1. A fluorescent lampholder fitting comprising: at least one fluorescent lamp of the preheat or rapid-start type having a first end provided with a starting filament including a first and second terminal wire, and a second end provided with a starting filament including a first and second terminal wire;

a male screw base electrical connector adapted to fit a three-way socket lampholder having an integral switch, said screw base extending from a generally hollow housing which supports the lamp in at least two places and said screw base being provided with three electrical input connections; a screw shell connection, a center connection and an intermediate ring connection;

a center-tapped step-down transformer having three terminals on its primary winding attached to the three respective connections of the three-way male screw base, and having a secondary winding with a low voltage output;

a full-wave bridge rectifier with its input connected to the output of the secondary winding of the step-down transformer;

a high-frequency oscillator with its input connected to the output of the full-wave rectifier and having a low voltage output;

a step-up transformer having its primary winding input connected to the output of the high-frequency oscillator, and having a tapped secondary winding including a first segment applying voltage across and current through at least one of the pairs of filament terminal wires, and a second winding segment applying voltage across and current through one of the leads of each respective lamp filaments.

2. A fluorescent lampholder fitting as in claim 1 in which at least one of the lamp filaments is operated in a cold cathode mode and the step-up transformer secondary winding has only one segment applying voltage across the opposed lamp terminals.

3. A fluorescent lampholder fitting as in claim 1 in which the step-up transformer has two electrically separate windings; a first winding having a first segment applying voltage across the first filament of a first lamp, a second segment applying voltage across the second filament of a first lamp, and a third segment applying voltage across opposed lamp terminals of a first lamp; and a second winding having a first segment applying voltage across the first filament of a second lamp, a second segment applying voltage across the second filament of the second lamp, and a third segment applying voltage across opposed terminals of the second lamp; whereby both lamps are operated simultaneously at a brightness consistent with the selected input connection of the screw base.

4. A fluorescent lampholder fitting as in claim 1 in which the step-up transformer has two electrically separate windings; a first winding having a first segment applying voltage across the first filament of a first lamp, and a second segment applying voltage across opposed lamp terminals of the first lamp; and a second winding having a first segment applying voltage across the first filament of a second lamp, and a second segment applying voltage across opposed terminals of the second lamp, whereby at least one filament of each lamp is operated in a cold cathode mode.

5. A lampholder fitting comprising:

at least one gas discharge lamp employing a fluorescent phosphor and having a first end provided with a lamp operating gas discharge electrode connected to a terminal wire, and a second end provided with a lamp operating gas discharge electrode connected to a first terminal wire and a second lamp starting gas discharge electrode in close proximity to the lamp operating gas discharge electrode and having a second terminal wire;

a male screw base electrical connector adapted to fit a three-way socket lampholder having an integral switch, said screw base extending from a generally hollow housing which supports the lamp and said screw base being provided with three electrical input connections; a screw shell connection, a center connection and an intermediate connection;

a center-tapped step-down transformer having three terminals on its primary winding attached to the three respective connections of the three-way screw base, and having a secondary winding with a low voltage output;

a full-wave bridge rectifier with its input connected to the output of the secondary winding of the step-down transformer;

a high-frequency oscillator with its input connected to the output of the full-wave rectifier and having a low voltage output;

a step-up transformer having its primary winding input connected to the output of the high-frequency oscillator, and having a tapped secondary winding including a first winding segment applying voltage across and current through the lamp operating electrode terminal wire and the lamp starting electrode terminal wire of the second lamp end, and a second winding segment applying voltage across and current through the lamp operating electrode terminal wire of the first lamp end and the lamp operating electrode terminal wire of the second lamp end.

* * * * *